United States Patent [19]

Magrath

[11] 4,050,460

[45] Sept. 27, 1977

[54] DEVICE AND METHOD FOR FEEDING FLUIDS TO CALVES AND THE LIKE

[76] Inventor: Joseph M. Magrath, P.O. Box 148, McCook, Nebr. 69001

[21] Appl. No.: 680,380

[22] Filed: Apr. 26, 1976

Related U.S. Application Data

[63] Continuation of Ser. No. 543,990, Jan. 1, 1975, abandoned.

[51] Int. Cl.[2] ..... A61D 7/00

[52] U.S. Cl. ..... 128/223; 128/232

[58] Field of Search ..... 128/223, 224, 226, 227, 128/239, 247, DIG. 24, 231, 232; 119/71; 215/41; 222/527, 528, 529

[56] References Cited

U.S. PATENT DOCUMENTS

| | | | |
|---|---|---|---|
| 152,046 | 6/1874 | Potter | 128/227 |
| 576,702 | 2/1897 | True | 222/527 |
| 716,304 | 12/1902 | Stearns | 128/227 |
| 951,044 | 3/1910 | Axford | 128/227 |
| 1,548,956 | 8/1925 | Rosenberg | 222/529 |
| 2,887,109 | 5/1959 | Barrington | 128/227 |
| 3,081,002 | 3/1963 | Tauschinski et al. | 128/DIG. 24 |
| 3,332,420 | 7/1967 | Voller | 128/227 X |
| 3,454,007 | 7/1969 | Salis | 128/239 X |
| 3,463,153 | 8/1969 | Gandi | 128/227 |
| 3,476,111 | 11/1969 | Matheson | 128/247 X |

FOREIGN PATENT DOCUMENTS

| | | | |
|---|---|---|---|
| 558,385 | 8/1923 | France | 128/227 |

*Primary Examiner*—John D. Yasko

*Attorney, Agent, or Firm*—Wm. Griffith Edwards

[57] ABSTRACT

A liquid feed injector for young animals and particularly calves comprises a collapsible reservoir and a rigid probe or feed tube connected by a relatively short length of flexible tubing. A fitting or closure cup for the reservoir is provided with an outlet nipple about which the flexible tube is attached and sealed. The construction facilitates the one-handed manipulation of the feeder while holding the animal's head with the other, the flexible tube acting as a shut-off valve during manipulation for placing the tube in the animal's throat. The reservoir may be flattened or rolled with the one hand during discharge of the fluid.

10 Claims, 8 Drawing Figures

DEVICE AND METHOD FOR FEEDING FLUIDS TO CALVES AND THE LIKE

This is a continuation, of application Serial No. 543,990, filed Jan. 1, 1975, now abandoned.

This invention relates to devices for feeding fluids to animals and particularly to an improved device which is manipulated by one hand for feeding liquids to baby calves.

The feeding of yound or baby calves in some instances is difficult for various reasons: scoured, dehydrated calves require artificial feeding, and sometimes when the calf's mother has been lost the calf will not feed from a bottle, or the calf will not feed for other reasons. Some form of artificial feeding then becomes necessary if the calf is to be saved. Various devices and practices have been devised to meet this problem. Flexible tubes have been employed which may be inserted through the calf's mouth and into its esophagus or further into its rumen or still further into its reticulum. These devices and methods have been used effectively for some applications, however, they have involved difficult handling problems and in many cases have required two persons in order to assure effective injection of the milk or other liquid food into the gastrointestinal tract. Accordingly, it is an object of this invention to provide an improved esophageal feeding device which is simple and easy to operate by one person.

It is another object of this invention to provide an improved fluid feeder for baby calves and the like.

Briefly, in carrying out the objects of this invention in one embodiment thereof, a straight esophageal probe or tube is connected to a flexible and collapsible reservoir by a highly flexible tube which may be bent to act as a shut-off valve and the probe and reservoir held in one hand while the probe is inserted through the animal's mouth and well into its esophagus. The probe is provided with an outlet knob or bulb which facilitates the insertion of the probe and prevents insertion into the trachea of the animal. Only one hand is required to hold the probe and reservoir while the other is used to hold the animal's head with its mouth open. After the probe has been inserted into the esophagus the flexible tube is straightened and the reservoir compressed to discharge the fluid into the esophagus and rolled up to effect complete discharge of the fluid.

The features of novelty which characterize this invention are pointed out with particularly in the claimed annexed to and forming a part of this specification. The invention itself, however, both as to its organization and its method of operation, together with further objects and advantages thereof, may best be understood upon reference to the following description taken in connection with the accompanying drawings wherein:

Figure 1:
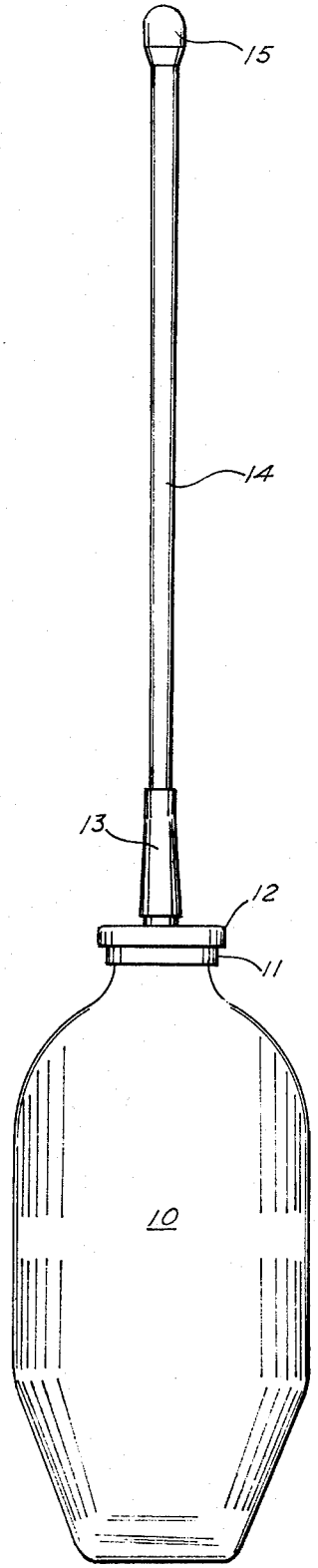
FIG. 1 is a front elevation view of a fluid feeding device embodying the invention.
Figure 2:
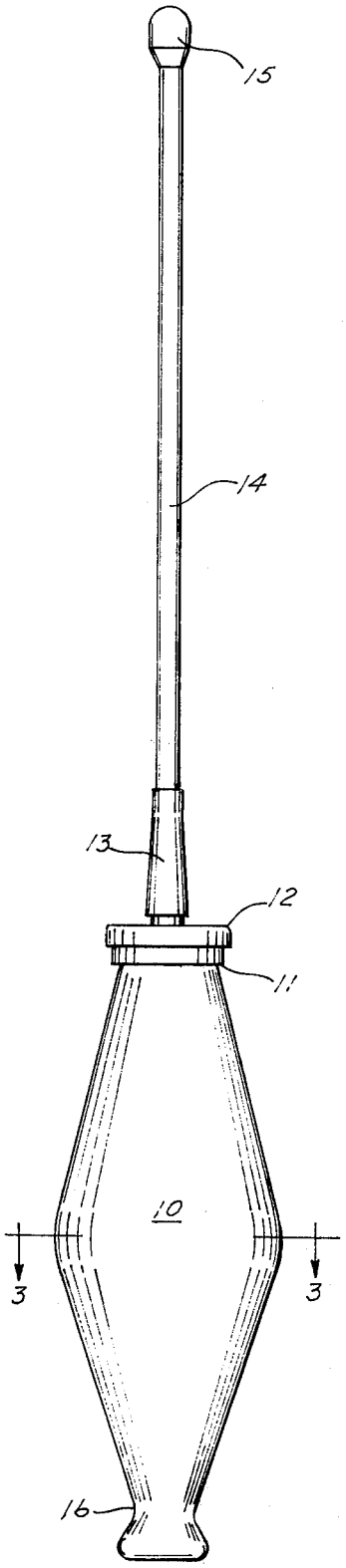
FIG. 2 is a side elevation view of the device of FIG. 1.

Referring now to the drawings, the device of FIGS. 1 and 2 comprises a flexible easily collapsible reservoir 10 which may be made of a durable plastic material and has a relatively rigid outlet boss or collar 11 on which is screwed a fitting 12 having an upwardly extending nipple to which is attached a short tube connector 13 of highly flexible rubber-like material. An esophageal probe 14 is fitted in the upper end of tube 13 and comprises a straight tube of stainless steel or other suitable material at the end of which an enlarged outlet knob 15 is secured to facilitate the insertion of the tube in the throat of the animal.

Figure 3:
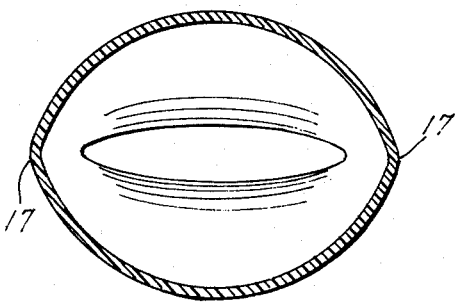
FIG. 3 is a sectional view of the reservoir of the device taken along the line 3—3 of FIG. 2.

The shape of the reservoir 10 as indicated in FIGS. 1, 2 and 3 is oblong in the plane of FIG. 1 and somewhat diamond shaped in the plane of FIG. 2. This configuration is such that the reservoir may be rolled up by gripping the lower end and turning it over toward the outlet end. The indentations along the sides of the lower closed end of the reservoir, as indicated at 16, form a necked in gripping portion to facilitate the holding and squeezing of the reservoir and the rolling or folding up of the reservoir as it is emptied. A single such side indentation may be sufficient for some applications. Further, the reduced size of the neck of the reservoir with respect to the collar 11 and cap 12 provides a grip for securely holding the reservoir while manipulating the probe 14. The cross section at the widest portion of the reservoir is oval or somewhat oval as indicated in FIG. 3. At the same time the sharper edges at 17 serve to determine the plane along which the reservoir may be flattened.

Figure 4:
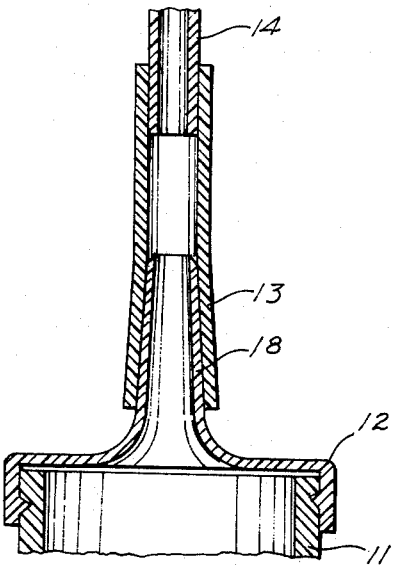
FIG. 4 is an enlarged sectional view of a portion of the device of FIG. 1.
Figure 5:
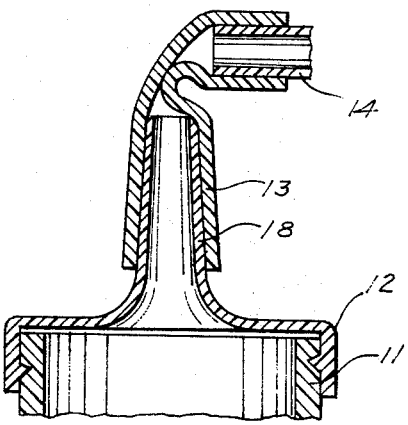
FIG. 5 is a view similar to FIG. 4 showing the outlet connection in bent position; and, FIGS. 6, 7 and 8 are illustrations of three steps in the use of the device.

The neck or collar 11 of the reservoir is provided with threads or grooves on which the cap 12 is threaded and securely fitted. The cap 12 is provides with an upwardly extending nipple 18 and the flexible tubing 13 and the lower end of the esophageal tube 14 is fitted in the upper end of the tube 13 as clearly shown in FIG. 4. This construction is such that when the probe 14 is turned back over the reservoir the tube 13 is bent and collapsed so that it acts as a valve shutting off the flow of fluids either in or out of the reservoir as indicated in FIG. 5 in which the tube is shown in a bent position with the esophageal probe substantially horizontal and the opposite walls of the tube 13 in engagement to close the tube passage. The length of the tubing 13 is sufficient short that it is bent and closed by turning movement of the probe 14 toward the reservoir 10; thus the tube 13 need not be pinched or otherwise separately squeezed to effect the closing of passage between the reservoir and the probe.

Figure 6:
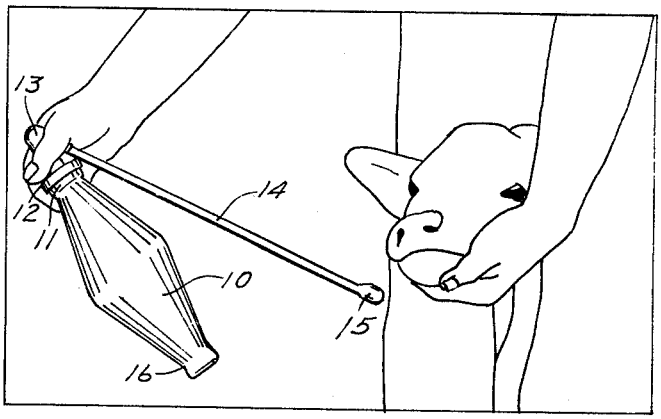

During the feeding of the calf the operator may hold the neck of the calf between his legs and the head in his left hand as indicated in FIG. 6. The feeding device is then held in the right hand with the esophageal tube turned back over the reservoir so that the tube 13 is flattened and shut off the flow of the liquid as shown in FIG. 5. The tube and reservoir are then moved toward one another and held in the right hand as illustrated. The calf's mouth is then opened and held open by the left and the esophageal tube or probe inserted until the end 15 is in the esophagus. The enlarged end 15 facilitates the insertion of the tube without entering the trachea so that the calf cannot be drowned when the fluid is discharged from the reservoir. FIG. 6 also illustrates how the diamond configuration of the reservoir allows the probe 14 to be held close to the reservoir during manipulation with the tube 13 bent to stop flow from the reservoir.

Figure 7:
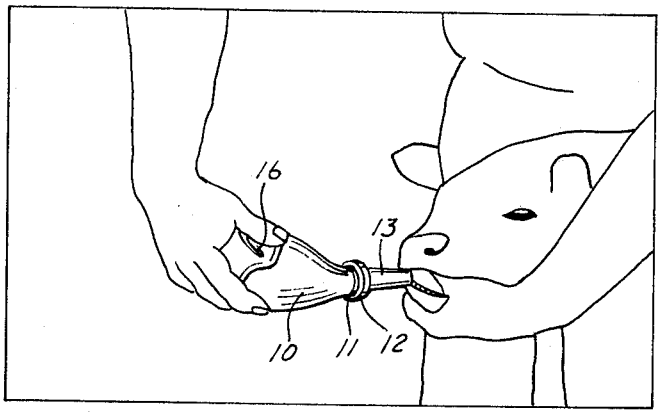

The reservoir is then straightened out into general alignment with the probe to open the valve and is squeezed as indicated in FIG. 7 to discharge the fluid into the esophagus. This procedure is continued until the reservoir has been completely flattened as shown in FIG. 8 whereupon the probe is removed.

Figure 8:
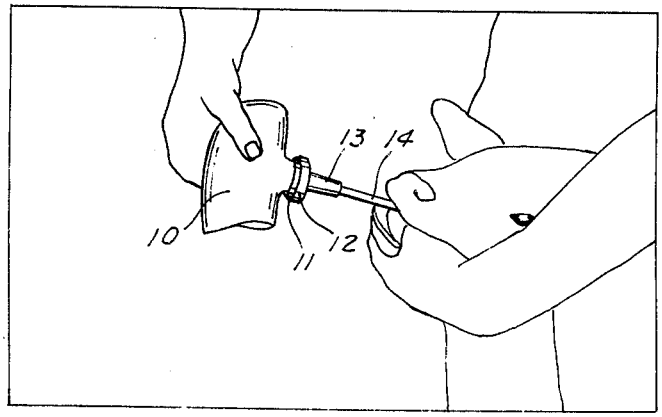

The ease with which the feeding device may be operated by one hand while holding the animal's head with the other is clearly evident from FIGS. 6, 7 and 8, and in practice it has been found that the device shortens the time for feeding, simplifies the feeding and facilitates the handling of the animal.

When the feeder is to be prepared for feeding, by way of example, a powdered feed may be poured into the reservoir after the cap 12 has been removed and the reservoir then filled with water. The water and feed are, of course, in the required proportions and are easily mixed by shaking the reservoir so that the feed solution is quickly prepared. The cap is then again fitted onto the reservoir and the device is ready for use.

Various other arrangements or applications may occur to those skilled in the art and it is not desired that the present invention be limited to the details of construction illustrated and described, and it is intended by the appended claims to cover all modifications which fall within the spirit and scope of the invention.

I claim:

1. A device for the manual feeding of fluids to animals which comprises:
   - a stiff esophageal probe tube having a protective enlargement at its discharge end;
   - a flexible and collapsible fluid reservoir having a relatively rigid outlet collar;
   - a detachable outlet fitting on said collar having an outlet nipple extending therefrom; and
   - a short length of flexible tubing fitted on said nipple at one end and on the inlet end of said probe at the other leaving a short length of free tubing therebetween affording swinging movement of said probe with respect to said nipple; said device being so constructed and arranged and the free length of said flexible tubing being sufficiently short that the tubing is collapsed and the passage therethrough closed by the swinging of said probe through a substantial angle from its unbent position whereby the passage of fluid therethrough is prevented.

2. A device for the manual feeding of fluids to animals as set forth in claim 1 wherein said reservoir is oblong in one plane and generally diamond shaped in a plane at right angles to said one plane and affording its being rolled up along said one plane during collapsing of the reservoir.

3. A device for the manual feeding of fluids to animals as set forth in claim 1 wherein said reservoir adjacent said outlet fitting is smaller than said outlet fitting.

4. A device for the manual feeding of fluids to animals as set forth in claim 1 wherein the closed end of said reservoir is necked in transversely to provide a grip for use during manipulation of the device and the squeezing and emptying of the reservoir.

5. A device for the manual feeding of fluids to animals which comprises:
   - a stiff esophageal probe tube having a protective enlargement at one end;
   - a flexible and collapsible fluid reservoir having a rigid outlet collar;
   - an outlet fitting constructed for attachment to said collar and having an outlet nipple extending therefrom; and,
   - a short length of flexible tubing connecting said probe to receive fluid from said reservoir, said tubing affording the turning movement of said probe and the reservoir toward one another and the length of the tubing being sufficiently short and being constructed and arranged so that the bending of said tubing by turning of the probe and reservoir toward one another collapses the tubing wall and shuts off the passage therethrough to prevent flow of fluid from said reservoir, said fitting and said collar being constructed and arranged for providing a hand grip for holding the probe and the reservoir together during manipulation of the probe with the passage from the reservoir closed, whereby the operator may manipulate said device with one hand.

6. A hand device as set forth in claim 5 wherein said reservoir if of diamond configuration in one longitudinal section whereby the probe may be turned back close to the reservoir for facilitating the gripping of the reservoir and probe by one hand.

7. A device for the manual feeding of fluids to animals as set forth in claim 1 wherein the free length of said tubing is about 2½ times the internal diameter of the tubing.

8. A device for the manual feeding of fluids to animals as set forth in claim 1 wherein said probe is substantially longer than said reservoir.

9. The method of feeding liquids to yound calves or other yound animals by utilizing a collapsible reservoir and rigid esophageal tube which comprises:
   - providing a short length of flexible tubing connecting the reservoir and the esophageal tube;
   - filling the reservoir with liquid feed;
   - swinging the esophageal tube about the flexible tubing nto a position toward the reservoir to bend and close the flexible tubing and holding the reservoir and tube together with one hand to maintain the tubing closed;
   - holding the animal's head in position with the other hand and inserting the esophageal tube into the animal's esophagus;
   - releasing the esophageal tube and moving the reservoir into general alignment with the tube to open the passage between the tube and the reservoir, and
   - squeezing the reservoir to force the liquid feed into the animal's esophagus.

10. The method of feeding liquids to young calves or other animals as set forth in claim 9 including the step of rolling the reservoir upon itself during the squeezing thereof to empty the liquid from the reservoir.

* * * * *